US007104358B2

(12) United States Patent
Frederiksen

(10) Patent No.: US 7,104,358 B2
(45) Date of Patent: Sep. 12, 2006

(54) SILENCER CONTAINING ONE OR MORE POROUS BODIES

(75) Inventor: Svend Frederiksen, Holte (DK)

(73) Assignee: Silentor Holding A/S, Hedenhusene (DK)

( * ) Notice: Subject to any disclaimer, the term of this patent is extended or adjusted under 35 U.S.C. 154(b) by 127 days.

(21) Appl. No.: 10/239,160

(22) PCT Filed: Mar. 21, 2001

(86) PCT No.: PCT/DK01/00192

§ 371 (c)(1),
(2), (4) Date: Dec. 19, 2002

(87) PCT Pub. No.: WO01/71169

PCT Pub. Date: Sep. 27, 2001

(65) Prior Publication Data

US 2004/0040782 A1 Mar. 4, 2004

(30) Foreign Application Priority Data

Mar. 21, 2000 (DK) ..... 2000-00475
Jun. 19, 2000 (DK) ..... 2000-00954

(51) Int. Cl.
*F01N 1/02* (2006.01)

(52) U.S. Cl. ..... 181/249; 181/211; 181/247

(58) Field of Classification Search ..... 181/211, 181/241–247, 232, 222, 224, 231
See application file for complete search history.

(56) References Cited

U.S. PATENT DOCUMENTS 4,533,015 A * 8/1985 Kojima ..... 181/280
5,426,269 A * 6/1995 Wagner et al. ..... 181/232
5,651,250 A * 7/1997 Kawamura ..... 60/303
5,828,013 A * 10/1998 Wagner et al. ..... 181/255
5,961,931 A * 10/1999 Ban et al. ..... 422/171
6,510,921 B1 * 1/2003 Price ..... 181/264

FOREIGN PATENT DOCUMENTS

| | | |
|---|---|---|
| DE | 1 476 627 | 4/1970 |
| DE | 14 78 627 A | 4/1970 |
| EP | 0 579 956 A | 1/1994 |
| EP | 0 579 956 A1 | 1/1994 |
| EP | 0 931 913 A | 7/1999 |
| EP | 0 931 913 A1 | 7/1999 |
| WO | 97 43528 A | 11/1997 |
| WO | WO 97/43528 | 11/1997 |
| WO | 98 14693 A | 4/1998 |
| WO | WO 98/14693 | 4/1998 |
| WO | 98 44243 A | 10/1998 |
| WO | WO 98/44243 | 10/1998 |
| WO | 99 02826 A | 1/1999 |
| WO | WO 99/02826 | 1/1999 |

* cited by examiner

*Primary Examiner*—Kimberly Lockett
(74) *Attorney, Agent, or Firm*—Birch, Stewart, Kolasch & Birch, LLP

(57) ABSTRACT

A silencer for silencing and also for filtering exhaust gases, contains at least one acoustic resonator chamber (13, 14, 15, 16) (Helmholtz frequency), at least one porous body (7, 8) the porous body (7, 8) occupying at least part of the chamber and at least one connecting passage (17) for leading gas from each one of the acoustic chamber wherein the connecting passage (17) extend along the outher surface of the porous body, so as to lead along a helical flow path (19).

63 Claims, 6 Drawing Sheets

HELMHOLTZ NATURAL FREQUENCIES OF A TWO-CHAMBER REACTIVE SILENCER INDICATING POTENTIAL FOR IMPROVED LOW-FREQUENCY NOISE ATTENUATION WHEN INTERNAL CONNECTING PIPE LENGTH L' IS BEING INCREASED.

SILENCER CONTAINING ONE OR MORE POROUS BODIES

This application is the national phase under 35 U.S.C. § 371 of PCT International Application No. PCT/DK01/00192 which has an International filing date of Mar. 21, 2001, which designated the United States of America.

TECHNICAL FIELD

The present invention relates to a silencer with a casing and at least one inlet passage for leading gas into said casing, and at least one outlet opening for leading gas out of the casing. The silencer contains at least one porous body which is provided for, e.g., purification of exhaust gasses. The silencer may for example be incorporated in an exhaust system of a vehicle or a stationary installation, such as a power plant.

BACKGROUND OF THE INVENTION

As a result of increasing demands for purification of combustion engine exhaust, combined with requirements for compact installation in many applications, for instance that of automotive exhaust systems, silencers are nowadays often designed to contain built-in purification equipment, such as particle filters and catalysers based on ceramic monoliths. Also, silencers are sometimes required to contain heat exchangers for the extraction of exhaust heat, for cabin heating or cooling, by means of a heat-driven chiller, such as an absorption chiller. When exhaust gas flows through such ceramic monoliths and heat exchangers, the flow is typically being divided into many small, parallel subflows. Accordingly, these elements can be designated as porous bodies.

Reactive silencers basically function as acoustical low-pass filters, i.e. they provide noise reduction at frequencies above a lower cut-off frequency f" below which there is no or little attenuation. In addition, the transition from no to full attenuation is often gradual, characterised by a second cut-off frequency f', which is somewhat higher than f". Such a second cut-off frequency typically occurs in the case of a silencer with two acoustical chambers being connected by an internal pipe. From acoustical theory it is known that f' and f" more or less coincide with natural oscillation frequencies, known as Helmholtz frequencies.

As discussed below in connection with FIG. 1, the natural (and cut-off) frequency can be lowered if connecting pipe length L' is made longer. This would result in improved low-frequency noise reduction, as discussed below in connection with FIG. 1.

However, with silencers of simple geometry, as indicated by the schematic of the figure, there is a limit to the possible length L', being ultimately the length of the casing, i.e. the sum of the lengths of the two chambers. In practice, since flow in and out of chambers has to be provided in a reasonable way, the limit length actually is lower, typically in the order of half the casing length or slightly more.

International Patent Applications Publication Nos. WO 98/14693 and WO 99/50539 provide solutions to this problem. A main idea disclosed in these patent applications is to use a curved, internal passage instead of a straight passage. It is shown how helical passages, extending inside a silencer close to the casing and winding e.g. 360 degrees, can result in a substantial increase in effective passage length, which is measured along the curved path from inlet (connected to a first chamber) and to passage outlet (connected to a second chamber).

These cited publications show that the principle of a curved passage, used with the purpose of enhancing low-frequency acoustical performance of two- or more chamber reactive silencers, can be applied both to classical silencers and to silencers containing monoliths. In the latter case, monoliths are shown to be connected in series with such curved passages and contained inside an acoustical chamber, having a diameter being only slightly less than that of the casing and being fixed to the casing, directly or via a heat-resistant, flexible layer. Such series connection of curved passages and monoliths, though, demands that the monoliths do not occupy too big a part of the total volume inside the silencer casing, assuming that a reasonably unrestricted flow in and out of chambers must be accommodated for.

In silencers containing monoliths, passages connecting acoustical chambers may be designed as annular passages surrounding such monoliths, instead of pipes. For instance, U.S. Pat. No. 5,426,269 teaches that such a passage can be used for leading gases along the outer cylinder of a catalytic monolith, in counterflow to flow through the monolith, in a combined silencer/catalyser having inlet and outlet pipes essentially at the same end of a cylindrical casing.

International Patent Application Publication No. WO 97/43528 further demonstrates how an annular passage surrounding one or more monoliths disposed inside a silencer and being penetrated by a central pipe, can be combined with accommodation of a rather long passage connecting two chambers. Here, the main purpose is to achieve a low cut-off frequency, as with curved, internal passages. Inlet and outlet pipes are connected to opposite ends of the casing. One of the embodiments shows how two monoliths, being for instance a particulate filter and a NOx-reducing catalyser, can be accommodated inside an extremely compact combined unit according to this invention.

This latter concept is especially attractive in cases where there is space for using a rather longish casing, because in such apparatuses the annular passage can attain a substantial length, constituting a rather low cut-off frequency associated with this passage. But in short silencers, the cut-off frequency goes up.

DESCRIPTION OF THE INVENTION

It is an object of the present invention to provide a suitable type of geometry for the internals of a reactive silencer containing one or more porous bodies, e.g. monoliths when very good attenuation performance is required down to low noise frequencies, even in the case of a rather short casing in which the porous body or bodies make up a substantial fraction of the total volume which makes it difficult to accommodate long internal passages connecting acoustic chambers of the silencer, such long passages otherwise being beneficial in terms of low frequency attenuation.

Accordingly, the invention provides a silencer with a casing and at least one inlet passage for leading gas into said casing, and at least one outlet opening for leading gas out of said casing, said silencer containing:

- at least one acoustic chamber contained in the casing,
- at least one porous body inside said chamber, the porous body occupying at least part of the chamber,
- at least one connecting passage for leading gas from each one of the at least one acoustic chamber to another of the at least one acoustic chamber or to an exterior environment or an exterior chamber, wherein at least part of at least one of said at least one connecting passage extends along an outer surface of the porous body, so as to lead gas along a helical flow path.

By leading the gas along a helical flow path along an outer surface of the porous body, longer connecting passages may be achieved, and accordingly lower cut-off/natural frequencies may be achieved, thereby conferring improved low-frequency damping.

The at least one acoustic chamber may comprise a first and a second acoustic chamber, in which case the at least one connecting passage preferably interconnects the at least two acoustic chambers.

The at least one porous body may comprise a filter which is designed to retain particles contained in the gas, or it may contain a ceramic monolith. The at least one porous body preferably has interior surface parts which are adapted to be in contact with the gas. The interior surface parts may carry a catalytic material promoting one or more chemical reactions reducing noxious components of said gas. The catalytic material may promote catalytic conversion of NOx.

The at least one porous body which has surfaces carrying a catalytic material may comprise a through-flow monolith. The porous body is preferably throughflowed by gas when the silencer is arranged in a working application, such as, e.g., in the exhaust system of a vehicle.

The at least one porous body may comprise a heat exchanger in which the gas exchanges heat energy with a second fluid which passes through the heat exchanger.

Preferably, at least one porous body combines:

filtering with catalysis, filtering with heat exchange, catalysis with heat exchange, or filtering with both catalysis and heat exchange.

In case two porous bodies are arranged in the silencer according to the invention, those two porous bodies are preferably arranged in series, i.e. one downstream of the other.

One of the porous bodies may comprise a catalytic converter, and the other one of the porous bodies may comprise a filter which is designed to retain particles contained in the gas. Preferably, the filter is arranged downstream of the catalytic converter. The catalytic converter is preferably adapted to generate $NO_2$ to enhance combustion of particles accumulated in the filter. The filter may comprise a particulate filter and may be made essentially from SiC. The filter may also be made essentially from cordierite.

In the silencer according to the invention, two or more monoliths may be arranged to be throughflowed by parallel gas flows and arranged adjacent to each other or with a distance between each monolith. Preferably, this is done in a mechanical design which provides solid and flexible mounting, as well as essential prevention of undesired by-pass flows.

In case two acoustic chambers are provided in the casing, one and only one connecting passage may interconnect the two chambers. Alternatively, more than one connecting passage may interconnect the two chambers, in which case the connecting passages may lead gas from one chamber to the other one in two or more parallel flows.

The connecting passage may cover at least 50% of the surface are of the outer surface area of the porous body. Substantially the entire surface area of the outer surface area of the porous body may be covered by the connecting passage.

The at least one connecting passage may be mechanically connected to the at least one porous body along the outer surface of which the connecting passages extends. The mechanical connection may be direct, or it may be indirect via one or more mechanical connecting members.

A distance may be provided between the at least one connecting passage and the at least one porous body. A spacing may be provided between the at least one connecting passage and the at least one porous body, the spacing being closed or adapted in such a way that sound essentially does not by-pass said passage.

Preferably, the radial extension of the at least one connecting passage is substantially constant throughout the length of the passage in the flow direction of gas flowing through the connecting passage. Alternatively, at least part of one of the connecting passage is designed in such a way that the flow area increases in the flow direction, the flow area increase preferably being such that a pressure recovery diffuser effect is attained. The flow area increase may be attained by gradual and/or abrupt increase of the radial extension of the at least one connecting passage in the flow direction. The flow area increase may also be attained or increased by gradual and/or abrupt increase of the passage width in the flow direction.

The at least one connecting passage may extends on an (imaginary) envelope which is substantially circular cylindrical. In other words, the outer boundaries of the connecting passage may define a circular cylindrical shape. Alternatively, the envelope which may be oval.

The at least one connecting passage may extends on an envelope with a cross-section which defines a closed figure composed by curved sections only or by partly curved and partly straight sections, in such a way that abrupt turnings in flow direction within the passage or passages are avoided.

The passage or passages may be shaped as winding pipes. The individual windings of the winding pipes may be arranged adjacent to each other, and the individual windings may be separated by common division walls. The winding pipes may be wound with such a pitch that there is an axial spacing between the windings.

The connecting passage or passages may be helical, and the helical passages may be created by insertion of one or more division members or walls inside an annular spacing. The division members may extend in a part of said annular spacing only. A width of at least part of at least one of said division members may decrease in the flow direction so as to cause increased width(s) of the helical passage(s) in the flow direction of the gas flowing in the passages.

The division member(s) or wall(s) is/are preferably shaped such that gas enters the annular spacing in a combined axial and peripheral direction and leaves said spacing in a direction with a smaller peripheral component than the peripheral component of the gas flow entering the annular spacing, so that the axial flow velocity decreases inside the passages.

Preferably, all flows in passages created by division members or walls are substantially identical, i.e. have the same fluid dynamic properties, such as velocities and velocity distributions, flow rates, pressure, etc.

A part of the at least one connecting passage may extends outside another part of the passage, e.g. so that a first part of the connection passage surrounds a second part of the connecting passage. In case a first and a second connecting passage are provided, the first connecting passage may extend along an outer surface of the second connecting passage, e.g. so that the first connecting passage surrounds the second connecting passage.

The at least one porous body may be penetrated by an extension into the silencer of at least one external pipe or external passage or by the connecting passage which leads gas through the porous body.

In case two acoustic chambers are provided in the silencer, and in case a porous body is provided in a downstream chamber, the outflow from the connecting passage may leave the passage at a plurality of locations along the periphery of the porous body, thereby forming an inlet to a flow field upstream of the porous body, in which flow field gas molecules are distributed across the inlet cross-section of the porous body.

In case the connecting passage is located downstream of a chamber with a porous body therein, the inflow to said at least one passage may enter the passage at a plurality of locations along the periphery of the porous body, thereby forming an outlet flow field downstream of the porous body, in which the flow field gas molecules are distributed across the outlet cross-section of the porous body.

In both of the two above-mentioned cases, the flow may turn inside a cavity when passing from the at least one passage to the porous body, or vice versa, the cavity containing flow guiding means, such as for instance straight or curved, radially extending vanes.

The inlet passage may located at or near one end of the casing, and the outlet opening may located at or near the same end of the casing, so that gas is led to and from the casing at or near the same end of the casing. Alternatively, the inlet passage and the outlet opening may be located at or near opposite ends of the casing, so that gas is led to and from the casing at or near opposite ends of the casing.

The outlet opening may comprise or be connected to a pipe or passage.

The effective distance between an inlet and an outlet of the at least one connecting passage is preferably F times the direct distance between said inlet and said outlet, F being at least 1.1. Thus, the effective distance, as measured in flow direction, between inlet and outlet of least one of the at least one connecting passage is F times the direct distance between in- and outlet, as measured in an axial direction of the helix defined by the coinciding with an overall flow direction in the silencer, said factor F being at least 1.1.

F may be at least 1.25, such as at least 1.5, such as at least 2.0, such as at least 3.0 or at least 5.0.

The at least one connecting passage may define a turning angle for the flow path of at least 180°, such as at least 360°, such as at least 600°.

In the silencer according to the invention, at least two acoustic chambers may be provided, and the two acoustic chambers may be interconnected by one or more connecting passages. In such a case, the silencer may be suited for installation in a piping system connected to a reciprocating machine or engine generating a prominent noise of frequency $f_{pulse}$ in the piping system, in which case the at least one connecting passage may be such formed and sized that the Helmholtz natural frequency f' constituted by the connecting passage and the two acoustic chambers fulfils the criterion:

$$f'=\phi f_{pulse}, \text{ where } \phi<1.$$

The piping system may e.g. comprise the exhaust system of a combustion engine running loaded at various rotational speeds above a certain minimum speed, the frequency equality being valid at that minimum speed.

The factor $\phi$ may be less than 0.75, such as less than 0.5, such as less than 0.25.

The above-mention Helmholtz natural frequency may be determined by combining theory with acoustical testing.

In case the at least one said porous body comprises a particulate filter, the Helmholtz natural frequency may be determined for said filter being heavily loaded with accumulated particulate matter.

The invention further provides a vehicle comprising a silencer according to the invention. The vehicle may, e.g., be a car, a truck, a bus, a locomotive, a ship or boat, or any other moveable/propelled device.

The invention also provided a stationary installation comprising a silencer according to the invention, such as, e.g., a stationary engine or a gas turbine of, e.g., a power generating station.

DETAILED DESCRIPTION OF THE DRAWINGS

Figure 1:
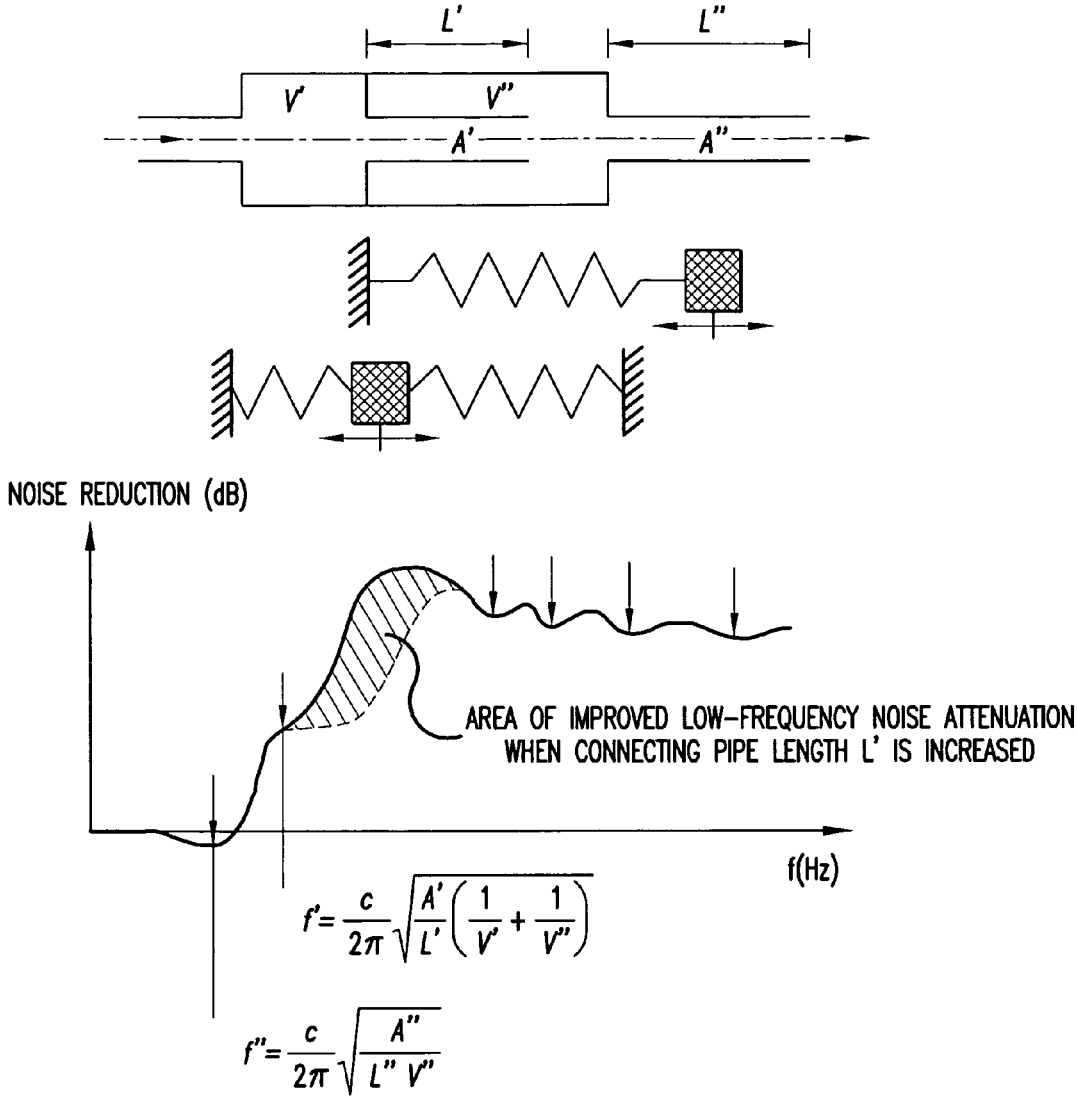
FIG.1 PRIOR ART
FIG. 1 illustrates basic attenuation/frequency diagrams for reactive silencers, FIGS. 2A, B and C show a first embodiment of a silencer according to the invention, in which inlet and outlet pipes are disposed at opposite ends of a casing, and a single, helically winding annular passage, extending along the cylindrical outside of two pipe-penetrated monoliths, connects two chambers.

FIG. 1 illustrates basic attenuation/frequency diagrams for reactive silencers. Noise reduction is provided at frequencies above a lower cut-off frequency f" below which there is no or little attenuation. In addition, the transition from no to full attenuation is gradual, characterised by a second cut-off frequency f', which is somewhat higher than f". Such a second cut-off frequency typically occurs in the case of a silencer with two acoustical chambers being connected by an internal pipe. From acoustical theory it is known that f' and f" more or less coincide with natural oscillation frequencies, known as Helmholtz frequencies.

Approximate formulae for these frequencies can be derived by considering gas masses in connecting and tail pipes (leading gas from the second chamber to the environment) as concentrated, oscillating masses, acting as pistons on the gas amounts contained in the two chambers of volumes V' and V". In the oscillatory movement the volume-contained gas amounts are being exposed to alternating (small) compressions and expansions in almost isentropic (adiabatic, reversible) changes of state, acting as springs attached to the oscillating masses.

Accordingly, the oscillatory behaviour can be viewed by mechanical mass-spring analogies as indicated below the schematic of the two-chamber reactive silencer. At top is shown the mass of gas contained in the tail-pipe (of length L" and cross-sectional area A"), connected to a spring constituting the flexibility of the second chamber and yielding the lower natural frequency f". Below is shown the mass of gas contained in the internal connecting pipe (of length L' and cross-sectional area A'), connected to springs constituting the flexibilities provided by both chambers. In the example shown, the natural frequency f" of the tail-pipe system is lower than that of the internal connecting pipe. With other dimensions, e.g. with a shorter tail-pipe, it could be vice versa. Strictly speaking, f' will below be taken as the Helmholtz frequency associated with the internal connecting pipe, irrespective of which of the two Helmholtz frequencies is the lower one.

In both formulae, c is speed of sound, being a function of gas temperature. By inspecting the formula for f', it can be seen that this natural (and cut-off) frequency can be lowered if connecting pipe length L' is made longer, in which case the mass of gas in this pipe is increased. This would result in improved low-frequency noise reduction, as indicated by the shaded area in the diagram of FIG. 1.

In FIG. 2, a casing 1 is connected to an inlet pipe 2 and an outlet pipe 3. The casing is composed by an outer cylinder 4 and end caps 5 and 6. A first monolith 7, which may be a particulate filter, and a second monolith 8, which may be an NOx-reducing catalyst, are both contained within an inner cylinder 9.

In the present patent application, it should be understood that the term "monolith" relates to the overall shape; a monolith may be composed of a number of joined or juxtaposed segments or of more monoliths being through-flowed in parallel.

An NOx-reducing catalyst will usually be combined with a system (not shown) for injecting ammonia or urea upstream of the unit, or at the inlet of the unit. A monolith 7 is penetrated by an extension of inlet pipe 2 into the silencer unit, and a monolith 8 is penetrated by an extension into the unit of the outlet pipe 3. Both monoliths are connected to these pipe extensions and to the inner cylinder 9 by flexible and heat-resistant layers 10 and 11. In addition, mechanical details (not shown) may be added to provide increased flexible fixation of monoliths, which are exposed to axial forces from gas flow passing through them.

Both monolithic bodies are of rotational cylindrical form, having conical inlet and outlet surfaces, which is beneficial from a fluid-flow point of view. Alternatively, conventional flat monolith end surfaces may be used for one more of these four surfaces, to reduce manufacturing costs and simplify design. A division wall 12 creates essentially two acoustical chambers inside the casing. Between this division wall and monoliths, and between the end caps 5 and 6 and monoliths, four small cavities 13, 14, 15, and 16, are disposed. Here, flow turns are distributed/collected across the inlet and outlet surfaces of the monoliths.

Since sound waves, especially low frequency sound waves, tend to penetrate monoliths, especially monoliths without channel closing and other open porous bodies, rather freely, the cavities 13 and 14, together with the inner, gas-contained volume of first monolith 7, constitute a first acoustical chamber. Likewise, cavities 15 and 16, together with the inner volume of the second monolith 8, together constitute a second acoustical chamber. Thus, the volumes of the monoliths are used for an acoustical purpose. In a compact design as the one shown, this may be significant, since smaller volumes confer higher cut-off frequencies (V' and V" appearing in denominators of formulae for f' and f", cf. FIG. 1).

Figure 2A:
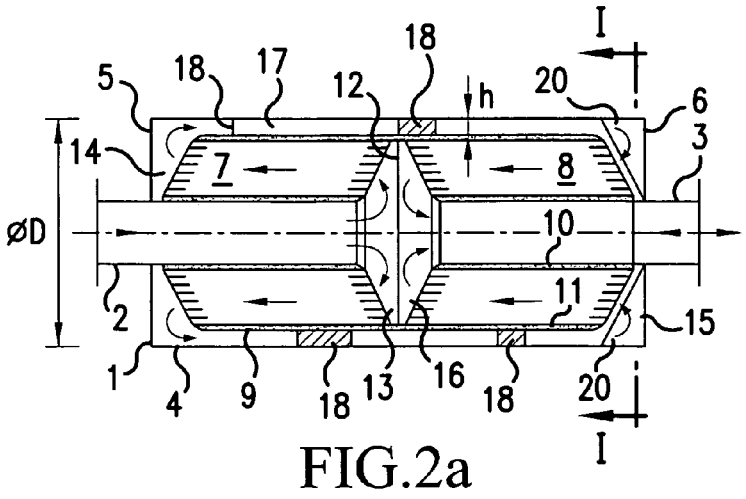

If a silencer is to accommodate other types of porous bodies in which sound propagates less freely, this may call for larger cavities than those indicated in FIG. 2A. That may be the case with heat exchangers in which heat transfer walls and heat receiving fluids occupy a significant part of the gross volume of the porous body.

Between the outer casing cylinder 4 and the inner cylinder 9 an annular passage 17 is created, which connects the cavities 14 and 15, and thus the two acoustical chambers of the reactive silencer. Inside this passage is fitted a division member 18, which extends in a helical fashion, whereby a long, helical passage 19 is created. The division member 18 (cf. FIG. 2C, which is a folded out view of the annular passage 17) has a width s which is bigger at flow inlet than at flow outlet. Thereby the flow passage width, w, increases in the flow direction, so that a diffuser conferring pressure recovery is created. This is beneficial, because a narrow inlet to the passage 19 increases sound reflection caused by the change in flow cross-sectional area when flow passes from chamber to the connecting passage. At the same time, the pressure recovery taking place in the diffuser reduces pressure loss across the combined silencer unit, both due to pressure rise along the passage and due to a smaller loss of dynamic energy of the gas when passing from the passage to the outflow acoustic chamber.

Figure 2B:
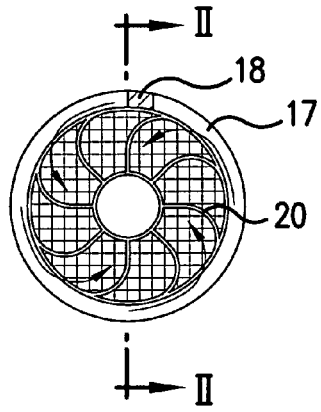

To assist uniform flow inlet to the monolith 8 and smooth flow without excessive swirl inside the cavity 15, flow guiding means may be provided, cf. FIGS. 2A and 2B. The flow guiding means may comprises curved, radially extending vanes 20. Alternatively, the end plate 6 may be provided with indentations to provide guiding means inside the cavity.

Figure 2C:
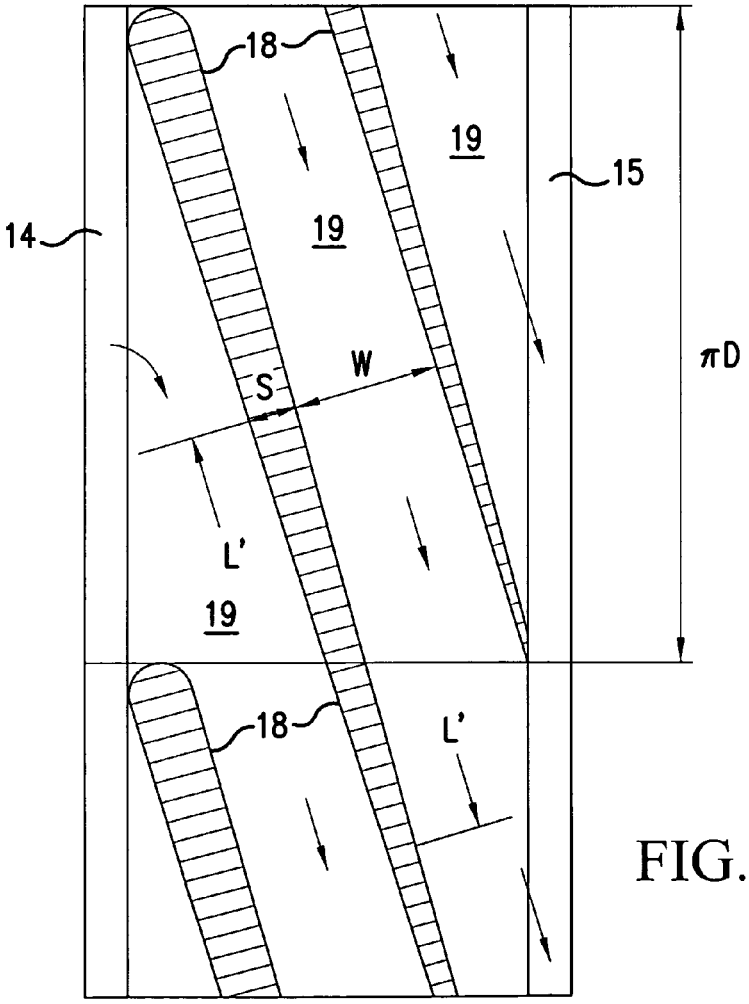

From FIG. 2C it can be seen that by designing the flow path to wind helically inside the annular channel 17, instead of a simple, axial flow, the effective passage length L' has been increased by a factor of the order of 3, which corresponds to a lowering of cut-off (natural) frequency f' by a factor F of about 1.7 (passage length L' appearing under a square root in the formula for f', cf. FIG. 1).

As can be seen, the effective passage length L' has been taken as a mean distance between in- and outlet of the helical passage 19 in the flow direction. The simple, geometrical distance can be measured in the axial direction of the helix, coinciding with the overall flow direction of the silencer, from inlet to outlet of the annular passage. The oblique in- and outlets of the helical passage will cause its acoustical length to appear less sharply in some respects. Thus, standing waves in the passage, such as for instance a half-wave resonance, will therefore be less prominent, which is beneficial from the point of view of acoustical performance of the silencer.

As has been pointed out above, the formula for L', which is given in FIG. 1, is simplified. Several phenomena can cause shift in natural frequency f':

Wave dynamics in chambers and passages

Frictional damping in the passage

Acoustical wave resistance caused by the monoliths, especially filter monoliths loaded with particles.

When designing a silencer according to the invention, one may start by selecting dimensions in accordance with the simple formula for f' and then modify the design, determining f' experimentally, to take the above-mentioned phenomena into account.

Figure 3A:
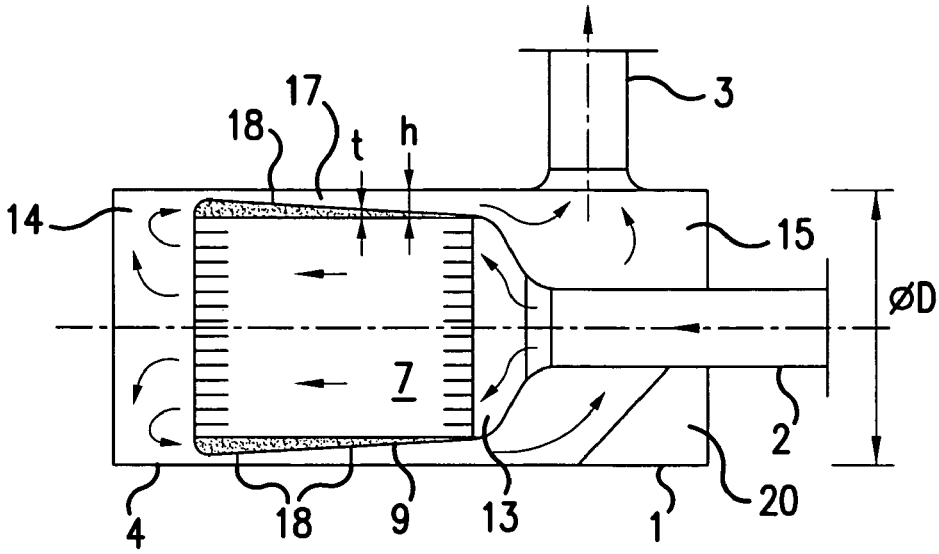
FIGS. 3A and B show a second embodiment in which inlet and outlet pipes are disposed at the same end of a casing, and an annular passage connecting two chambers extends along a single, full monolith, the passage flow being divided into more parallel, helical flows by curved division walls.

FIGS. 3A and B show a second embodiment of the invention. Here, a single and full monolith 7 is surrounded by an annular helical passage 17 connecting an acoustical first chamber, comprised by cavities 13 and 14 as well as an inner volume of the monolith, with a second acoustical chamber 15. An inlet pipe 2 and outlet pipe 3 are positioned essentially at the same end of the casing 1. An inner member 9 (corresponding to the inner cylinder 9 of the first embodiment of FIG. 2) has a thickness t which decreases slightly in the flow direction, whereby the annular passage height h, i.e. the radial extension of the passage increases, thereby conferring a diffuser effect.

Figure 3B:
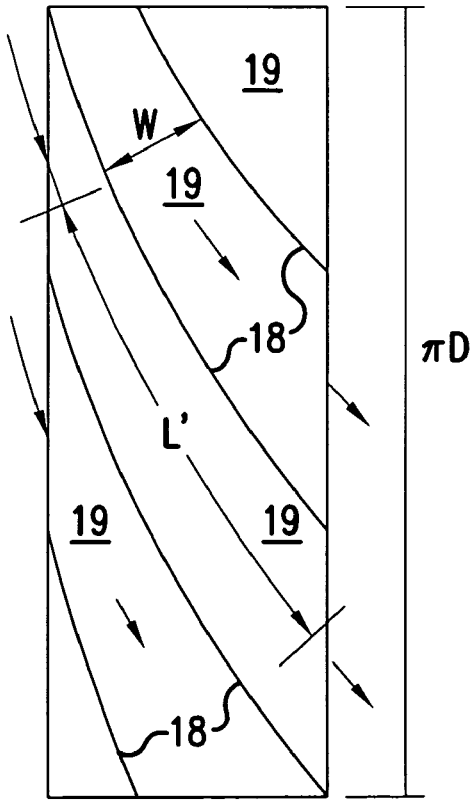

FIG. 3B contains a folded-out view of the annular passage 17. Three division walls 18 divide the annular passage flow into three parallel, helically extending flows 19. The walls 18 are curved, whereby flow direction changes from passage inlet to passage outlet. Thus, at passage outlet the flow has a smaller peripheral velocity component. Even if passage height h had not increased along the flow inside the passages, the curvatures of division walls would thereby have caused a decrease in absolute flow velocity, being the resultant of combined peripheral and axial velocity components. Thus an increased diffuser effect is attained. The number of division walls should preferably be so high that no major flow separation occurs along division walls. With the dimensions indicated on the drawing of FIG. 3, connecting passage length L' increases by around a factor F=2 compared to simple axial flow through the annular passage 17.

A radially extending plate 20 is fitted inside the chamber 15 to prevent excessive swirling fluid motion.

Figure 4A:
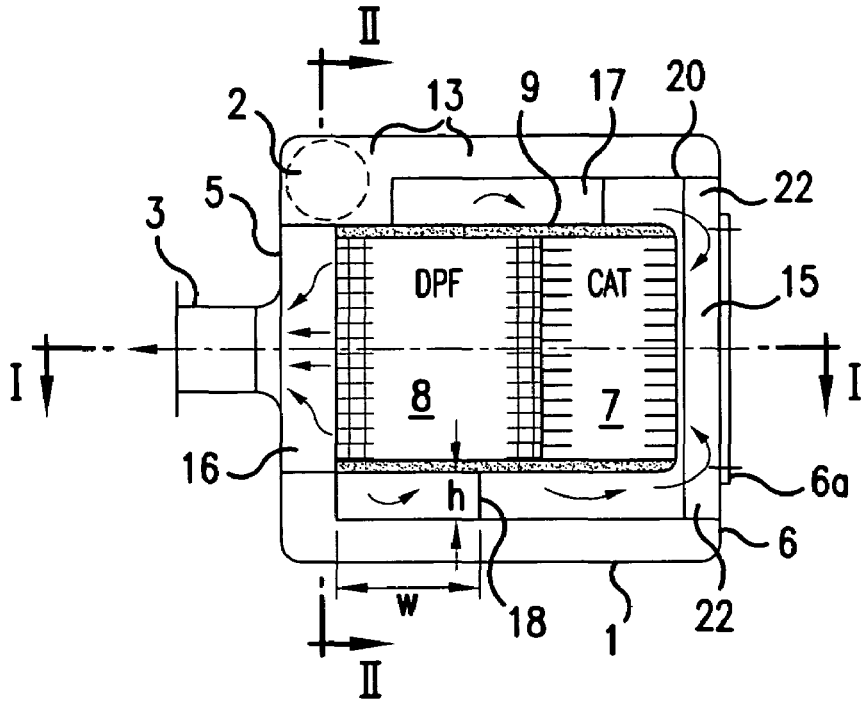
FIGS. 4A, B, C and D show a third embodiment, in which a single helical passage extends inside a cubic-like casing and outside two monoliths.
Figure 4B:
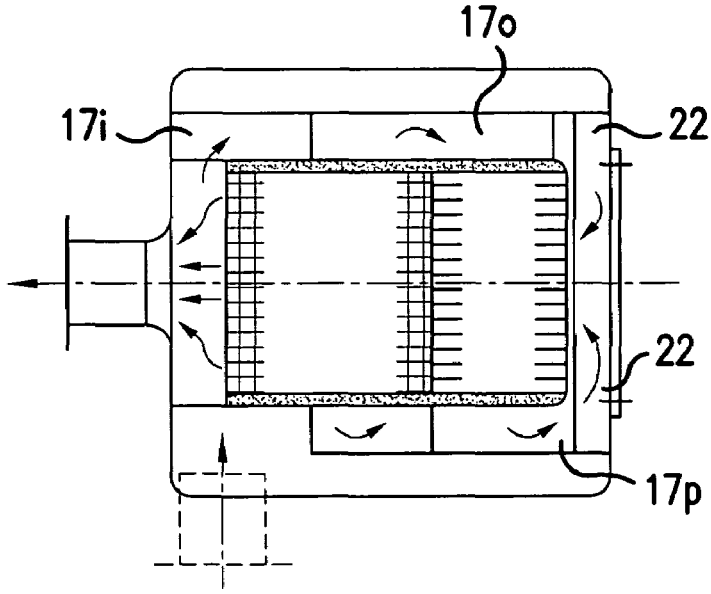
Figure 4C:
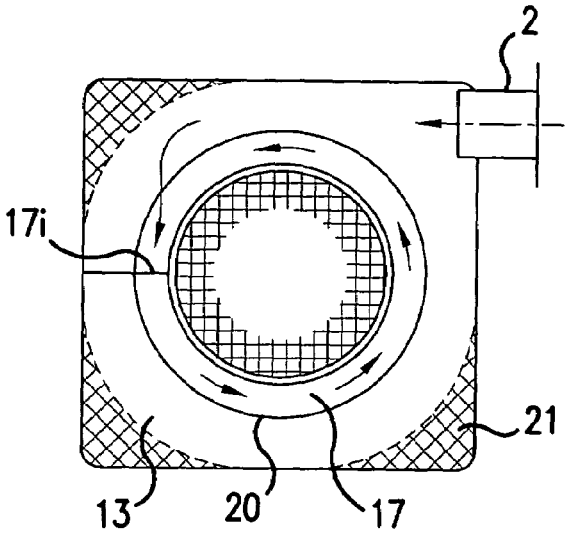
Figure 4D:
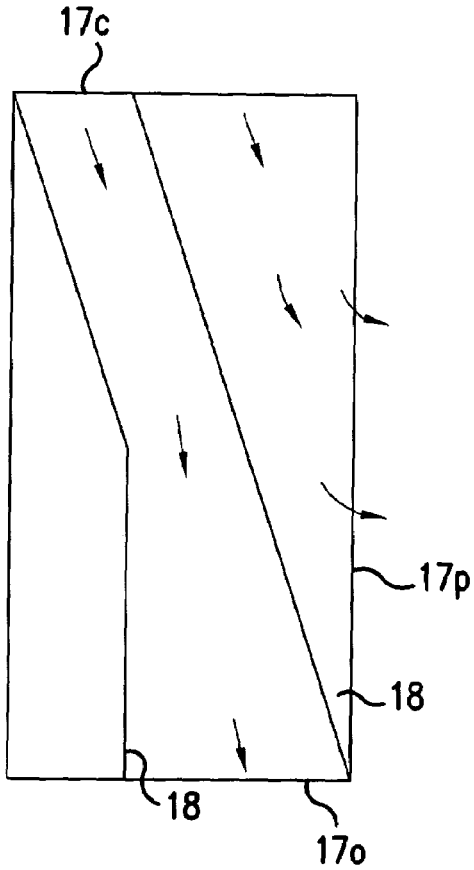

FIGS. 4A, B, C and D show a third embodiment of the invention. FIGS. 4B and C are cross-sectional views, indicated as I—I and II—II, respectively, in FIG. 4A. FIG. 4D is a folded-out view of a helical connecting passage 17.

In this embodiment, the casing is cubic-like, a shape which is often used in modern trucks, to achieve a maximum of silencer volume within given geometric restrictions. The embodiment further shows how the invention can be used to accommodate both a catalytic converter 7 and a particulate filter 8 in serial connection inside the casing. The catalytic converter may for instance be designed to generate $NO_2$ to enhance combustion of particles accumulated in the filter, in accordance with the principles disclosed in EP 0 341 832.

A helical passage 17 is wound outside two monoliths and is positioned between an inner cylinder 9 and an outer cylinder 20. The passage connects a first chamber 13 with a second chamber which essentially is made up of an aggregate volume, constituted by cavities 15 and 16, together with gas-filled porosities of the monoliths 7 and 8. Close to an outer side wall 5 (to the left in FIG. 4A), the nner cylinder 9 constitutes a division between first and second chambers. Close to an opposite, outer side wall 6, the outer cylinder 20 constitutes the division wall. The first chamber 13 extends all the way between the two above-mentioned side walls as well as between the outer square casing and the two cylinders inside the casing.

The helical passage 17 may be viewed as a winding pipe with a rectangular cross-section, which is of constant height h, but whose width w in the latter half of the passage gradually increases to create a diffuser. Gas enters the passage at inlet 17*i*. The pipe part of the passage 17 ends at an opening 17*o* after 360 degrees' turning. From there, the flow continues into an annular space which is open towards a cavity 15 at an outlet 17*p*.

While in the second embodiment of the invention (cf. FIG. 3B) more co-extending passages (parallel channels 19) connect two chambers, there is only one such passage in the first (cf. FIG. 2C) and third embodiments (cf. FIG. 4D). As can be seen especially from FIG. 4A, using the invention to choose a single, winding passage will cause the height-to-width-ratio, h/w, to increase, as compared to a simple annular flow of the same cross-sectional area and the same mean diameter of the annulus (mainly given by the diameter of the monoliths). Thereby the hydraulic diameter of the passage increases, and the pressure loss per unit flow length decreases.

The end wall 6 is fitted with a demountable disc 6*a*, making it possible to take out the monoliths 7 and 8 for service. Straight guide vanes 22 extending radially are provided to assist smooth, non-swirling turning of flow inside the cavity 15. Sound absorptive material 21, protected by perforated, curved plates, occupies three of the four corners of the square, as can be seen in FIG. 4C.

In the embodiment shown, division wall 18 is common to two adjacent windings of the helical passage. Alternatively, the helical passage could be made from a full pipe, wound up with side walls of adjacent pipe sections touching each other. Or a greater pitch of the winding could be selected, leaving axial space between the windings.

It may be desired to increase the effective size of the second acoustical chamber compared to the size ratio indicated in the drawing, at the expense of the size of the first acoustical chamber. This can be done by designing the cylinder 20 to be shorter, i.e., not extending right to the side wall 6, but instead leaving an opening, in combination with insertion of a division wall between the cylinder 20 and the casing, e.g., halfway between the side walls 5 and 6.

Figure 5A:
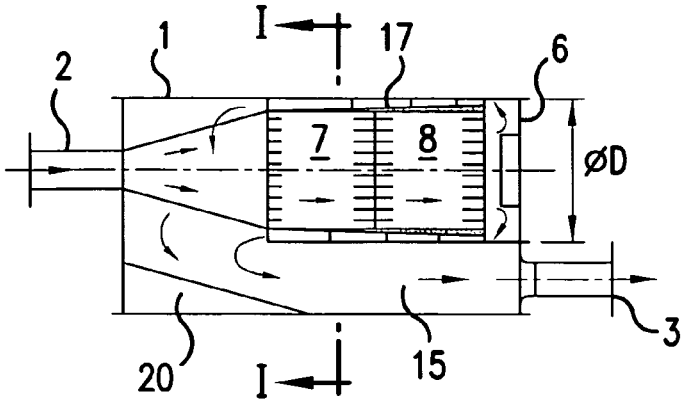
FIGS. 5A, B and C show a fourth embodiment in which a chamber connecting, helical passage is particularly long, surrounding monoliths inside an oval-shaped silencer.
Figure 5B:
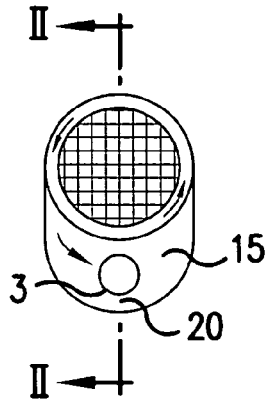

FIGS. 5A, B and C show a fourth embodiment of the invention in which a particularly long, helical passage 19, created by a long division wall 18 inside an annular channel 17 surrounding two monoliths 7 and 8, has been fitted into a silencer. The silencer shell is oval-shaped as is often used in under-vehicle installations. A baffle 20 prevents excessive flow swirl inside chamber 15.

The monolith 7 may be an NOx-reducing catalyser, combined with (not shown in the figure) urea injection into a pipe 2, upstream of the silencer. The monolith 8 may be a particulate filter. The end cap 6 may be designed with a de-mountable lock, for the purpose of easy access to the monolith 8 for de-mounting and cleaning.

Figure 5C:
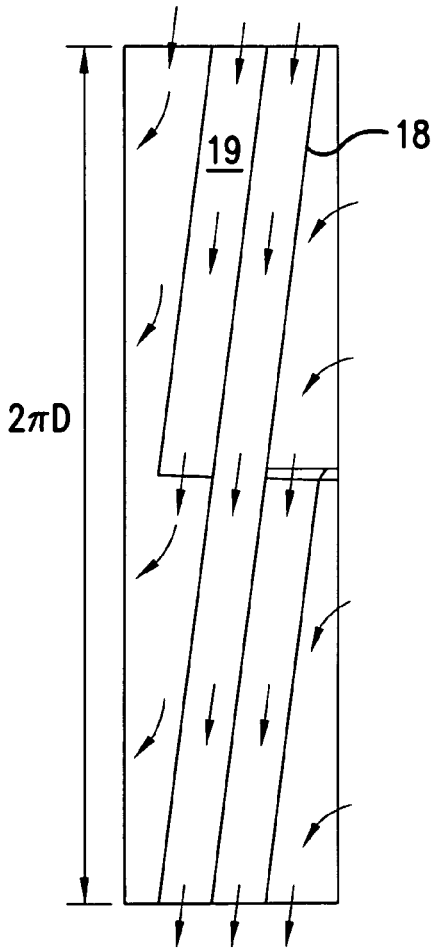

The passage 19 winds two times, i.e. 720 degrees, around the monoliths. Therefore, folded-out view in FIG. 5C has been extended to cover two windings. A rather long connecting passage as the one shown will be particularly appropriate in the case of a silencer adapted for a passenger car. Due to smaller gas flows in exhaust systems from passenger car engines, e.g. compared with engines for trucks, catalyser monoliths, filter monoliths and silencer shells are all generally smaller. Therefore, to obtain a low Helmholtz natural frequency f' for two silencer acoustical chambers connected by an internal passage, a rather long such passage is called for.

In the four embodiments of the invention shown, various geometries are shown which illustrate how helical passages can be adopted to increase acoustically effective length at the passage by various factors F. By specifying at minimum F of 1.1, one may cause a small but necessary adjustment of effective length L'. Typically, for instance in truck and bus applications, values of F>1.25, 1.5 or 2.0 may be needed. Bigger values, such as F>3.0 or 5.0 may for instance be appropriate in passenger car applications, where silencers are smaller, thus calling for bigger increases of effective connecting passage length L'.

In the case of silencers for turbo-charged engines it is important to keep the pressure loss across the silencer unit within certain limits, to avoid excessive back-pressure to the engine. In the case of engines without turbo-charging, bigger—but of course not unlimited—pressure losses can be allowed for. For instance, when designing a compact monolith-containing silencer for the un-turbocharged engine of a lawn-mover, one may combine selection of a length-extended connecting passage, according to the invention, with design for a rather narrow passage flow area, in particular at passage inlet. Thereby it may be possible to attain a low Helmholtz natural frequency f', even with a rather small silencer volume.

Somewhat, but not absolutely, linked to choice of factor F is choice of number of degrees' winding of helical passages. For different applications, winding angles being at least 180, 360, or even 600 degrees may be called for.

Devices according to the invention are particularly useful when compact silencers containing porous bodies are installed in a piping system passing gas through a reciprocating machine generating a dominant pulse noise frequency $f_{pulse}$ inside the piping system. In the case of a combustion engine, for instance the prime mover of a vehicle, this pulse noise frequency is often termed the ignition frequency of the engine. The ignition frequency follows the rotational speed of the engine, i.e. if the engine runs slower, the ignition frequency is lowered, and the demand for low frequency noise attenuation increases accordingly. Usually there will be a lowest rotational speed of the engine running loaded, which will provide the most difficult case from the point of view of attenuating low frequency exhaust noise.

If one or more helical passages can be selected sufficiently long (and narrow), the Helmholtz natural frequency f' constituted by at least one such passage connecting two chambers will be lower than $f_{PULSE}$ even at the lowest rotational speed of the loaded prime mover.

Thus, the invention can be adopted to achieve, for one or more Helmholtz natural frequencies: $f' < \phi f_{pulse}$. The simple specification given by $\phi < 1$ will suffice in some cases. More often, however, it will be better to specify a margin. In very compact designs it may not be possible to choose a big margin; $\phi < 0.9$ can be chosen in such cases. Since cut-off of noise attenuation in the damping spectrum of the silencer is not abrupt (cf. FIG. 1), a bigger margin given by $\phi < 0.75$ is better, provided there is room for it.

Experience shows that even at frequencies below the dominant pulse frequency some low frequency noise attenuation may be called for. One example is big, V-engines with two cylinder rows; here, exhaust noise at 0.5 times $f_{pulse}$ may be rather strong. Another example is provided by noise inside vehicle cabins; here various low frequency components, caused by exhaust noise, may be heard and cause nuisance. In such cases, it may be relevant to specify $\phi < 0.5$ or even $\phi < 0.25$.

The four embodiments of FIGS. 2–5 further illustrate a variety of geometries incorporating diffusers inside annular passages surrounding monoliths.

What is claimed is:

1. A silencer with a casing and at least one inlet passage for leading gas into said casing, and at least one outlet opening for leading gas out of said casing, said silencer containing:

at least one acoustic chamber contained in the casing, at least one porous body inside said chamber, the porous body comprising a through-flow body occupying at least part of the chamber, where said at least one porous body has interior surface parts which are adapted to be in contact with the gas, the interior surface parts carrying a catalytic material promoting one or more chemical reactions reducing noxious components of said gas, at least one connecting passage for leading gas from each one of the at least one acoustic chamber to another of the at least one acoustic chamber or to an exterior environment or an exterior chamber, wherein at least part of at least one of said connecting passages extends along an outer surface of the porous body, so as to lead gas along a helical flow path.

2. A silencer according to claim 1, in which at least one of said at least one porous body comprises a filter which is designed to retain particles contained in the gas.

3. A silencer according to claim 2 in which said at least one filter porous body comprises a ceramic monolith.

4. A silencer according to claim 1 in which said at least one porous body carries catalytic material promoting catalytic conversion of NOx.

5. A silencer according to claim 1 in which at least one porous body which has surfaces carrying a catalytic material comprises a through-flow monolith.

6. A silencer according to claim 1 in which at least one of said at least one porous body comprises a heat exchanger in which the gas exchanges heat energy with a second fluid which passes through said heat exchanger.

7. A silencer according to claim 1 in which at least one of said at least one porous body combines:

filtering with catalysis, filtering with heat exchange, catalysis with heat exchange, or filtering with both catalysis and heat exchange.

8. A silencer according to claim 1, containing at least two throughflowed porous bodies, the at least two throughflowed porous bodies being arranged in series.

9. A silencer according to claim 8, in which one of the throughflowed porous bodies comprises a catalytic converter, and the other one comprises a filter which is designed to retain particles contained in the gas.

10. A silencer according to claim 9, wherein the filter is arranged downstream of the catalytic converter.

11. A silencer according to claim 10, wherein the catalytic converter is adapted to generate $NO_2$ to enhance combustion of particles accumulated in the filter.

12. A silencer according to claim 9, wherein the filter comprises a particulate filter.

13. A silencer according to claim 9, wherein the filter is made essentially from SiC.

14. A silencer according to claim 9, wherein the filter is made essentially from cordierite.

15. A silencer according to claim 1 in which at least one of said at least one porous body comprises two or more monoliths arranged to be throughflowed by parallel gas flows and arranged adjacent to each other or with a distance between each monolith.

16. A silencer according to claim 1, comprising two acoustic chamber in said casing, and wherein one and only one passage interconnects the two chambers.

17. A silencer according to claim 1, comprising two acoustic chamber in said casing, and wherein more than one passage interconnects the two chambers, the passages leading gas from one chamber to the other one in two or more parallel flows.

18. A silencer according to claim 1, wherein the at least one connecting passage covers at least 50% of the surface area of said outer surface area of the porous body.

19. A silencer according to claim 1, in which the at least one passage covers substantially the entire surface area of said outer surface area of the porous body.

20. A silencer according to claim 1 in which the at least one connecting passage is mechanically connected to the at least one porous body along the outer surface of which the connecting passages extends.

21. A silencer according to claim 1 in which there is a distance between said at least one connecting passage and said at least one porous body.

22. A silencer according to claim 21 in which there is a spacing between said at least one connecting passage and said at least one porous body, said spacing being adapted in such a way that sound essentially does not by-pass said passage.

23. A silencer according to claim 1 in which the radial extension of said at least one connecting passage is substantially constant throughout the length of the passage.

24. A silencer according to claim 1 in which at least part of one of said connecting passages is designed in such a way that the flow area increases in the flow direction.

25. A silencer according to claim 24 in which said flow area increase is attained by gradual and/or abrupt increase of the radial extension of said at least one connecting passage in the flow direction.

26. A silencer according to claim 24 in which a said flow are increase is attained or increased by gradual and/or abrupt increase of the passage width in the flow direction.

27. A silencer according to claim 1 in which said at least one connecting passage extends on an envelope which is substantially circular cylindrical.

28. A silencer according to claim 1 in which said at least one connecting passage extends on an envelope which is oval.

29. A silencer according to claim 1 in which said at least one connecting passage extends on an envelope with a cross-section which defines a closed figure composed by curved sections only or by partly curved and partly straight sections, in such a way that abrupt turnings in flow direction within said passage or passages are avoided.

30. A silencer according to claim 1, in which the passage or passages are shaped as winding pipes.

31. A silencer according to claim 30, in which the individual windings of the winding pipes are arranged adjacent to each other.

32. A silencer according to claim 31 in which the individual windings are separated by common division walls.

33. A silencer according to claim 30, in which the winding pipes are wound with such a pitch that there is an axial spacing between the windings.

34. A silencer according to claim 1 in which one or more of said helical passages is/are created by insertion of one or more division members or walls inside an annular spacing.

35. A silencer according to claim 34 in which said division members only extend in a part of said annular spacing.

36. A silencer according to claim 34 in which at least part of one of said connecting passages is designed in such a way that the flow area increases in the flow direction, and in which a width of at least part of at least one of said division members decreases in the flow direction so as to cause increased width(s) of helical passage(s) in flow direction.

37. A silencer according to claim 34 in which at least part of one of said connecting passages is designed in such a way that the flow area increases in the flow direction, and in which said division member(s) or wall(s) is/are shaped such that gas enters said annular spacing in a combined axial and peripheral direction and leaves said spacing in a direction which is closer to axial direction, in such a way that flow velocity decreases inside said passages.

38. A silencer according to claim 34 in which all flows in passages are created by division members or walls are substantially identical.

39. A silencer according to claim 1 in which part of said at least one connecting passage extends outside another part of said passage.

40. A silencer according to claim 1 in which said at least one connecting passage comprises a first and a second connecting passage, and in which the first connecting passage extends along an outer surface of the second connecting passage.

41. A silencer according to claim 1 in which at least one of said at least one porous body is penetrated by an extension into the silencer of at least one external pipe or external passage or by at least one of said at least one connecting passage which leads gas through said porous body.

42. A silencer according to claim 1 in which the outflow from said at least one passage leaves said passage at a plurality of locations along the periphery of said at least one porous body, thereby forming an inlet to a flow field upstream of said porous body, in which flow field gas molecules are distributed across the inlet cross-section of said porous body.

43. A silencer according to claim 1 in which the inflow to said at least one passage enters said passage at a plurality of locations along the periphery of at least one of said at least one said porous body, thereby forming an outlet flow field downstream of said porous body, in which the flow field gas molecules are distributed across the outlet cross-section of said porous body.

44. A silencer according to claim 42 in which the flow turns inside a cavity when passing from said at least one passage to said porous body, or vice versa, said cavity containing flow guiding means.

45. A silencer according to claim 1 in which said inlet passage is located at substantially one end of said casing, and in which said outlet opening is located at substantially the same end of the casing.

46. A silencer according to claim 1 in which said inlet passage is located at substantially one end of said casing, and in which said outlet opening is located at substantially the opposite end of the casing.

47. A silencer according to claim 1 in which said outlet opening comprises a pipe or passage.

48. A silencer according to claim 1 in which the effective distance between an inlet and an outlet of said at least one connecting passage is F times the direct distance between said inlet and said outlet, F being at least 1.1.

49. A silencer according to claim 48 in which F is at least 1.25.

50. A silencer according to claim 48 in which F is at least 1.5.

51. A silencer according to claim 48 in which F is at least 2.0.

52. A silencer according to claim 48 in which F is at least 3.0.

53. A silencer according to claim 48 in which F is at least 5.0.

54. A silencer according to claim 1 in which said at least one connecting passage defines a turning angle of the flow path of at least 180 degrees.

55. A silencer according to claim 54 wherein said turning angle is at least 360 degrees.

56. A silencer according to claim 54 wherein said turning angle is at least 600 degrees.

57. A silencer according to claim 1, wherein said at least one acoustic chamber comprises at least two acoustic chambers interconnected by said at least one connecting passage, the silencer being suited for installation in a piping system connected to a reciprocating machine or engine generating a prominent noise of frequency $f_{pulse}$ inside said piping system, the at least one connecting passage being such formed and sized that the Helmholtz natural frequency f' constituted by said connecting passage and said two acoustic chambers fulfils the criterion:

$$f'=\phi f_{pulse} \text{ where } \phi<1.$$

58. A silencer according to claim 57, wherein $\phi<0.75$.

59. A silencer according to claim 57 wherein $\phi<0.5$.

60. A silencer according to claim 57, wherein $\phi<0.25$.

61. A silencer according to claim 1, comprising at least two acoustic chambers, and wherein said at least one connecting passage interconnects said at least two acoustic chambers.

62. A vehicle comprising a silencer with a casing and at least one inlet passage for leading gas into said casing, and at least one outlet opening for leading gas out of said casing, said silencer containing:

at least one acoustic chamber contained in the casing, at least one porous body inside said chamber, the porous body comprising a through-flow body occupying at least part of the chamber, where said at least one porous body has interior surface parts which are adapted to be in contact with the gas, the interior surface parts carrying a catalytic material promoting one or more chemical reactions reducing noxious components of said gas, at least one connecting passage for leading gas from each one of the at least one acoustic chamber to another of the at least one acoustic chamber or to an exterior environment or an exterior chamber, wherein at least part of at least one of said connecting passages extends along an outer surface of the porous body, so as to lead gas along a helical flow path.

63. A stationary installation comprising a silencer with a casing and at least one inlet passage for leading gas into said casing, and at least one outlet opening for leading gas out of said casing, said silencer containing:

at least one acoustic chamber contained in the casing, at least one porous body inside said chamber, the porous body comprising a through-flow body occupying at least part of the chamber, where said at least one porous body has interior surface parts which are adapted to be in contact with the gas, the interior surface parts carrying a catalytic material promoting one or more chemical reactions reducing noxious components of said gas, at least one connecting passage for leading gas from each one of the at least one acoustic chamber to another of the at least one acoustic chamber or to an exterior environment or an exterior chamber, wherein at least part of at least one of said connecting passages extends along an outer surface of the porous body, so as to lead gas along a helical flow path.

* * * * *